US011462131B2

(12) United States Patent
Ljunggren

(10) Patent No.: US 11,462,131 B2
(45) Date of Patent: Oct. 4, 2022

(54) INFORMATION DISPLAY STAND WITH SNAP-IN LOCKING ASSEMBLY

(71) Applicant: Satins AB, Ängelholm (SE)

(72) Inventor: Jesper Ljunggren, Mellbystrand (SE)

(73) Assignee: Satins AB, Ängelholm (SE)

( * ) Notice: Subject to any disclaimer, the term of this patent is extended or adjusted under 35 U.S.C. 154(b) by 16 days.

(21) Appl. No.: 17/125,267

(22) Filed: Dec. 17, 2020

(65) Prior Publication Data

US 2021/0192979 A1 Jun. 24, 2021

(30) Foreign Application Priority Data

Dec. 20, 2019 (SE) ..... 1951538-6

(51) Int. Cl.
*G09F 1/10* (2006.01)
*G09F 1/06* (2006.01)

(52) U.S. Cl.
CPC ..... *G09F 1/10* (2013.01); *G09F 1/065* (2013.01)

(58) Field of Classification Search
CPC ..... G09F 1/10; G09F 1/065; G09F 15/0062; G09F 15/0025; A47F 5/11
See application file for complete search history.

(56) References Cited

U.S. PATENT DOCUMENTS 1,962,089 A * 6/1934 Davidson ..... G09F 1/04 248/459
8,590,188 B2 11/2013 Mirsch
8,826,833 B1 * 9/2014 Fischer ..... A47B 43/00 108/165
10,170,020 B2 1/2019 Cwidak et al.
2002/0171023 A1 11/2002 L'Hotel
2007/0245610 A1 * 10/2007 Mestres Armengol ..... A47F 5/112 40/610
2008/0083146 A1 4/2008 Presa
2008/0244948 A1 10/2008 L'Hotel
2009/0014606 A1 * 1/2009 Kelly ..... G09F 1/065 292/137
2011/0179685 A1 7/2011 Mirsch
2012/0227297 A1 * 9/2012 Kawaguchi ..... G09F 1/14 40/610
2015/0265070 A1 * 9/2015 Mestres Armengol ..... G09F 1/065 248/174

(Continued)

FOREIGN PATENT DOCUMENTS

DE 202010011039 U1 11/2010
DE 202010011407 U1 11/2010

(Continued)

*Primary Examiner* — David R Dunn
*Assistant Examiner* — Christopher E Veraa
(74) *Attorney, Agent, or Firm* — Capitol City TechLaw

(57) ABSTRACT

An information display stand is built up by two panels and two transverse locking inserts by means of which the stand can be expanded from an idle flat state to an expanded state of use. Each locking insert has a tongue member and a tongue receiving member which are in sliding connection. By this sliding, the locking inserts can assume an extended form corresponding to the idle formation of the stand and a retracted form corresponding to the expanded state of the stand. The tongue member and the tongue receiving member have matching engagement means which form a stopping mechanism for the locking assembly.

20 Claims, 15 Drawing Sheets

(56) References Cited

U.S. PATENT DOCUMENTS

| | | | | |
|---|---|---|---|---|
| 2017/0249874 | A1 | 8/2017 | Fernandez | |
| 2018/0075781 | A1* | 3/2018 | Cwidak | G09F 1/10 |
| 2018/0075788 | A1* | 3/2018 | Warmus | G09F 1/065 |

FOREIGN PATENT DOCUMENTS

| | | | |
|---|---|---|---|
| DE | 202010015220 | U1 | 2/2011 |
| DE | 202010015312 | U1 | 2/2011 |
| DE | 202011002980 | U1 | 5/2011 |
| DE | 102012001264 | A1 | 8/2012 |
| DE | 202014008337 | U1 | 12/2014 |
| EP | 1741368 | A1 | 1/2007 |
| EP | 1918900 | A2 | 5/2008 |
| EP | 2174573 | A1 | 4/2010 |
| EP | 2650862 | B1 | 9/2019 |
| FR | 2897970 | A1 | 8/2007 |
| FR | 2911425 | A1 | 7/2008 |
| FR | 2959053 | | 10/2011 |
| GB | 2470019 | A | 11/2010 |
| JP | 3163481 | | 7/1998 |
| JP | 5037300 | B2 | 9/2012 |
| SE | 537072 | C2 | 12/2014 |
| WO | 9628803 | A1 | 9/1996 |
| WO | 2005013772 | A1 | 2/2005 |
| WO | 2006040438 | A1 | 4/2006 |
| WO | 2007092440 | A2 | 8/2007 |
| WO | 2010018272 | A1 | 2/2010 |
| WO | 2010019086 | A1 | 2/2010 |
| WO | 2011076158 | A1 | 6/2011 |
| WO | 2014080047 | A1 | 5/2014 |

* cited by examiner

INFORMATION DISPLAY STAND WITH SNAP-IN LOCKING ASSEMBLY

This application claims priority under 35 USC 119(a)-(d) from Swedish Application No. 1951538-6 filed on Dec. 20, 2019, the entire contents of which are incorporated herein by reference.

BACKGROUND

1. Technical Field

The present invention relates in general to an information display stand configured to assume a first formation in which the stand is planar for storage or transportation, and a second formation in which the stand is expanded and capable of assuming an upright displaying position. More specifically, the invention concerns a locking assembly which is configured to be included in an information display stand and which maintains the stand in its expanded formation for upright position of use.

2. Discussion of Related Art

Information display stands have been used in the promotion industry for many years. Stands of this structure are oftentimes referred to as pop-up display stands. One type of such stand is disclosed in WO2010/019086A1, which has two panels and which can assume a first configuration in which the stand is flattened for transport or storage, and a second configuration in which the stand is extended, hence self-supporting. This known information presenting stand has a locking member arranged between the panels, for continuously adjustable locking of the stand in the two configurations. The locking member is self-locking by means of a friction band coupling formed between contact surfaces of the two parts of the locking member.

A drawback with friction-based means in locking members in such display stands, is the unspecific length of the locking member that may arise during the manufacturing process, where the locking member parts are joined to become a unit. If the locking member is too short, it does not fit between the two panels and excess manual work is needed to fasten the locking member between the two panels. A similar problem occurs if the locking member turns out to be too long.

In FR2959053A1, an information display stand is disclosed which has a first element of a tie rod that is fixed proximate a side edge to a flexible plate forming a first display panel, and a second member that is attached to a second flexible plate proximate a second side edge. The first and second members are configured to couple from a sliding position in a direction urging the first and second side edges, so as to prevent sliding in opposite directions and thereby maintaining the first display face convex.

Further background art is reflected for instance in WO2007/092440A2 and EP2650862A2.

A problem with the prior art discussed above arises for instance in the initial critical moment during which the convex shape of the display stand panels is determined. Hence, there is room for improvements.

SUMMARY

An object of the present invention is to solve or at least mitigate the problems related to prior art. This object has now been achieved by means of the technique set forth in the appended independent claims; preferred embodiments being defined in the related dependent claims.

In a first aspect, there is provided an information display stand configured to assume a first formation in which the stand is substantially planar for storage or transportation, and a second formation in which the stand is expanded and capable of assuming an upright displaying position. The stand has a center axis and comprises at least two panels that are joined together along respective edge portions, such that the stand in the second formation forms a substantially tubular shape, and at least one elongated locking assembly arranged between the two panels. The locking assembly extends transversely with respect to the center axis and has its respective ends attached to the panels at the respective edge portions. Furthermore, the locking assembly is configured to assume an extended form corresponding to the first formation of the stand, and a retracted locking form corresponding to the second formation of the stand.

The locking assembly of this improved stand comprises a tongue member and a receiving member, wherein the tongue member is in sliding connection within an opening of the receiving member. The tongue member comprises at least one protrusion configured to engage with at least one matching recess in the receiving member, such that when the tongue member and the receiving member are brought together a stopping mechanism is established by engagement between the protrusion and the recess, thereby keeping the stand in the second expanded formation.

A stand according to this aspect is favourable in that the snap-in locking features of the locking assembly facilitate the handling of the stand. It is easy to switch between the two formations of the stand. Furthermore, each locking assembly of the stand is of robust structure which secures efficient handling and use of the stand.

The stopping mechanism of the locking assembly obtained by matching engagement means of the tongue member and the tongue receiving member promotes a stepwise locking operation of the locking assembly.

In an embodiment, when then locking assembly is in its retracted form, it has two central wall portions which protrude in opposite directions with respect to a central plane of the locking assembly.

Preferably, the central wall portions are configured to engage with opposite inner surfaces of the panels in a transition between the first and second formation of the stand.

In another embodiment, when the locking assembly is in its retracted form, each of the two central wall portions of the locking assembly has a pointed shape with an outer tip which in the transition between the first and second formation is preferably in engagement with the inner surface of the adjacent panel.

In yet another embodiment, the two central wall portions together comprise toggle joint means configured to shift between a first and a second wall portion position during transition between the extended and the retracted form of the locking assembly, respectively.

In a further embodiment, the first and second wall portion positions determined by the toggle joint means are induced by a tipping point determined by applied outer forces acting on the locking assembly. A tipping point threshold is determined by the material features of the locking assembly.

In an embodiment, the sliding connection in the locking assembly between the tongue member and a tongue receiving area of the receiving member is substantially frictionless in that the distance between opposite sliding connection surfaces of the tongue receiving area of the receiving member is larger than the material thickness of the tongue member to be received in the tongue receiving area. This structure is beneficial, since the handling and operation of the locking assembly is smooth and efficient. It is easy to switch the stand from its two positions.

Preferably, the material thickness of the tongue member is between 40-90% of the distance between the opposite sliding connection surfaces of the tongue receiving area of the receiving member. Most preferred, this thickness proportion is 55-75%.

In a second aspect, there is provided a locking assembly to be included in a two-panel information display stand. The locking assembly comprises a tongue member and a receiving member; said members being in sliding connection within an opening of the receiving member. The tongue member comprises at least one protrusion configured to engage with a matching recess in the receiving member, such that when the tongue member and the receiving member are brought together, a stopping mechanism is established by engagement between the protrusion and the recess, thereby keeping the stand in an expanded formation.

In an embodiment, the locking assembly is configured to assume an extended form corresponding to a substantially planar formation of the stand, and a retracted locking form corresponding to the expanded formation of the stand. In its retracted form, the locking assembly has two central wall portions protruding in opposite directions with respect to a central plane of the locking assembly.

Preferably, the locking assemblies for the information display stand are formed from a one-piece blank which is folded along folding lines to the final insert shape. The locking assemblies are suitable to produce in a folding machine to which flat blanks are fed. Preferably, the blanks consist of corrugated board easy to fold.

Further features of the invention and its embodiments will be explained in the following description.

BRIEF DESCRIPTION OF THE DRAWINGS

By way of example, embodiments of the present invention will now be described with reference to the accompanying drawings, in which.

DETAILED DESCRIPTION OF EMBODIMENTS

Figure 1:
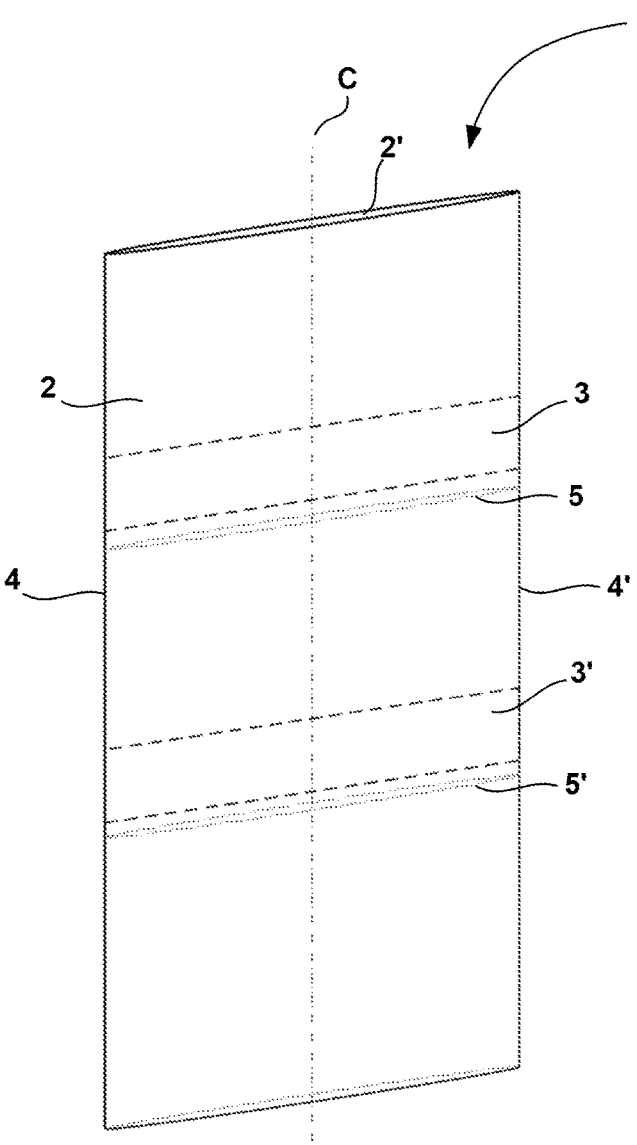
FIG. 1 is a side view of an information display stand in its idle position.

An information display stand 1 in accordance with an embodiment of the invention is shown in FIGS. 1-4. The information display stand 1 is also referred to as a pop-up stand in the following. In FIG. 1, the stand 1 is illustrated in its first state or formation representing an idle position. Here, the stand 1 is substantially flat and planar in order to enable efficient storage and/or transportation. Two elongated panels 2, 2' are joined together along their respective edge portions 4, 4'. Between the panels 2, 2' inside the information display stand 1, elongated locking assemblies 3, 3' are disposed which extend transversely with respect to a center axis C of the stand 1. The locking assemblies 3, 3' are also referred to as locking inserts. Both the panels 2, 2' and the locking assemblies 3, 3' may be of the same material, for example a paper material, such as corrugated board. Moreover, the material is flexible, yet rigid or semi-rigid.

Figure 3:
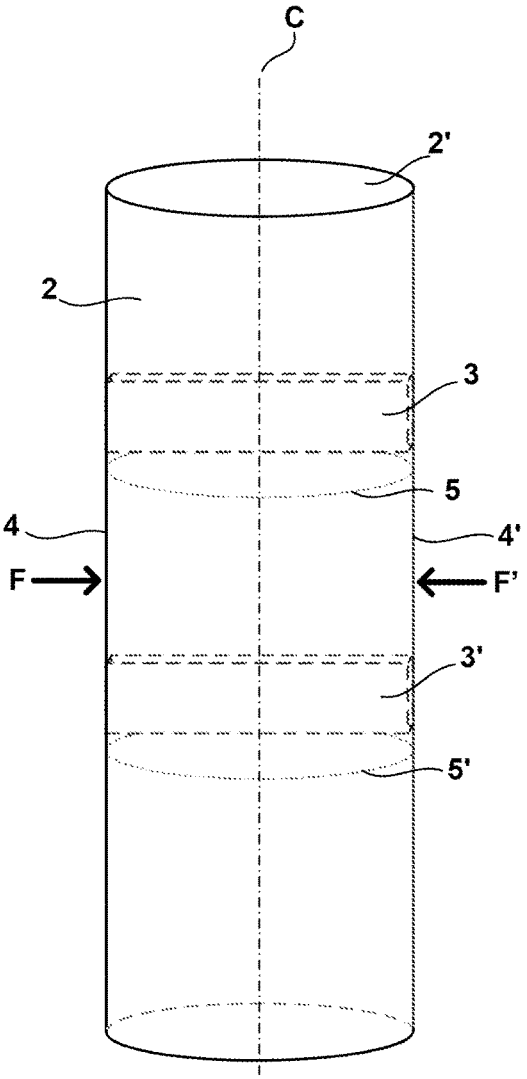
FIG. 3 is a front view of the stand in its position of use.

The locking assemblies 3, 3' are schematically illustrated as rectangular boxes in FIGS. 1 and 3, where the dashed lines indicate their placement between the panels 2, 2' inside the stand 1. Furthermore, the dotted lines on the panels 2, 2' indicate fold lines 5, 5'. The purpose of these fold lines 5, 5' is to enable folding of the stand 1 in its first formation such that the stand 1 can be flattened for storage and/or transportation.

Figure 2:
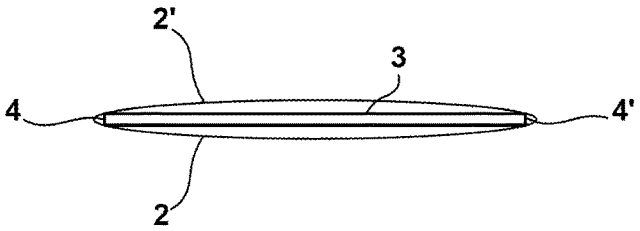
FIG. 2 is a top view of the stand shown in FIG. 1.

The stand 1 is illustrated in its idle position as seen in a top view in FIG. 2. Here, the locking assembly 3 is arranged between the panels 2, 2' and has its respective ends attached to the panels 2, 2' at their respective edge portions 4, 4'. Moreover, the locking assembly 3 is in an extended position, corresponding to the idle position of the stand. Notably, the same description applies to the other locking assembly 3' shown in FIGS. 1 and 3.

In FIG. 3, the stand 1 is illustrated in its second state or formation, representing a position of use. Here, the stand 1 is in an expanded form, i.e. in an upright displaying position, having a substantially cylindrical or tubular shape. In relation to FIG. 1, the locking assemblies 3, 3' in FIG. 3 are in a retracted position, hence pulling the panel edge portions 4, 4' closer to each other and leading to the tubular shape of the stand.

Figure 4:
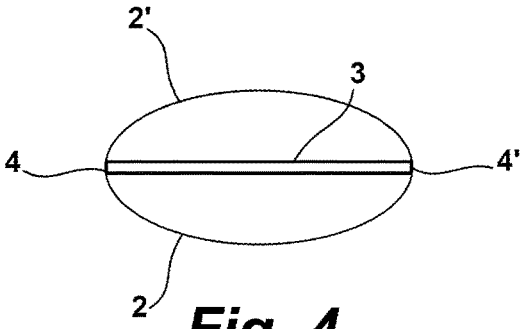
FIG. 4 is a top view of the stand shown in FIG. 3.

The stand 1 is illustrated in its position of use as seen in a top view in FIG. 4. Here, the locking assembly 3 is in a retracted locking position. The locking assembly 3 is attached to the panels 2, 2' at their respective edge portions 4, 4', thereby expanding the two panels 2, 2' such that the stand 1 takes on its second formation.

Three versions of the locking insert 3, 3' are shown in subsequent FIGS. 5-8, FIGS. 9-12 and FIGS. 13-16, respectively. They all have features in common such as a tongue member 6*a*, 6*b*, 6*c* and a receiving member 7*a*, 7*b*, 7*c*, where the tongue member 6*a*, 6*b*, 6*c* is in sliding connection within an opening 8*a*, 8*b*, 8*c* of the receiving member 7*a*, 7*b*, 7*c*. The width of this opening 8*a*, 8*b*, 8*c* is determined by the material thickness of the blank from which the locking insert 3 is assembled. The process of folding the blank will be described further in the following. Moreover, the opening 8*a*, 8*b*, 8*c* of the receiving member 7*a*, 7*b*, 7*c* is also referred to as a slit.

In all locking assemblies 3*a*, 3*b*, 3*c*, the tongue member 6*a*, 6*b*, 6*c* comprises at least one protrusion 9*a*, 9*b*, 9*c* which is configured to—in a reversible manner—engage with at least one matching recess 10*a*, 10*b*, 10*c* in the receiving member 7*a*, 7*b*, 7*c* such that the locking assembly 3*a*, 3*b*, 3*c* is able to transition between an extended form (see FIGS. 5-6, FIGS. 9-10 and FIGS. 13-14) and a retracted locking form (see FIGS. 7-8, FIGS. 11-12 and FIGS. 15-16). As exemplified in FIGS. 5, 9 and 13, any part of the receiving member 7*a*, 7*b*, 7*c* may comprise a recess 10*a*, 10*b*, 10*c*, as long as it has a matching protrusion 9*a*, 9*b*, 9*c* on the tongue member 6*a*, 6*b*. 6*c*.

Additionally, in all versions of the locking insert 3, 3', the tongue member 6*a*, 6*b*, 6*c* also comprises a shoulder 11*a*, 11*b*, 11*c* which, when brought into contact with a wall portion 12*a*, 12*b*, 12*c* of the slit 8*a*, 8*b*, 8*c*, maintains the locking mechanism of the locking assembly 3*a*, 3*b*, 3*c* when in its retracted position.

A first version of a locking insert 3*a* is shown FIGS. 5-8, where the at least one protrusion 9*a* of the tongue member 6*a* is provided on a tongue member edge portion and the matching recess 10*a* is provided on an opposite receiving member edge portion of the receiving member 7*a*. Together, the tongue member edge portion and the receiving member edge portion are disposed within the locking assembly 3*a*. Hence, in FIG. 5, these parts are not visible seen from the side.

Figure 5:
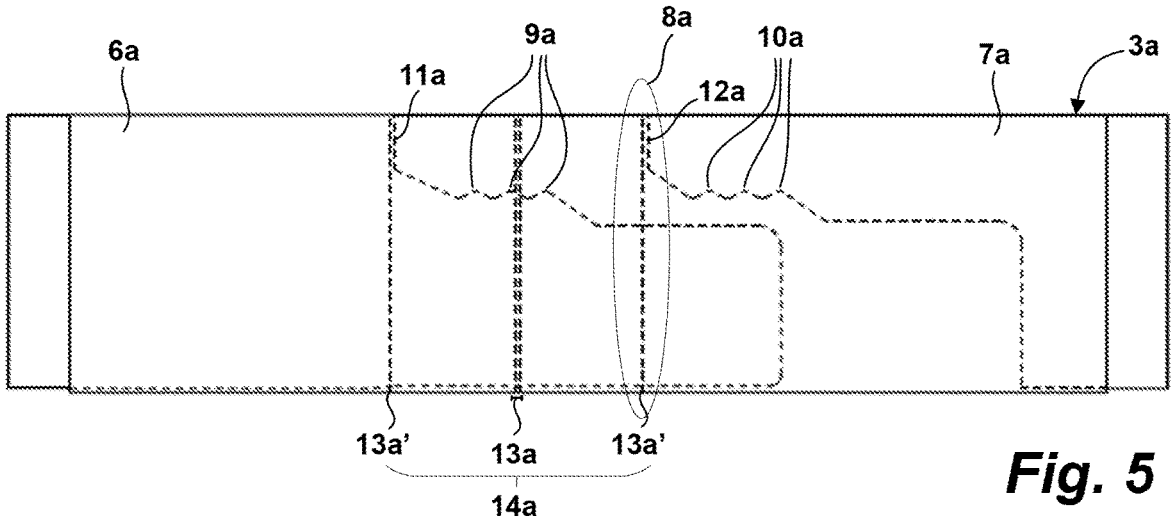
FIG. 5 shows a locking assembly of a first embodiment in its extended form.
Figure 6:
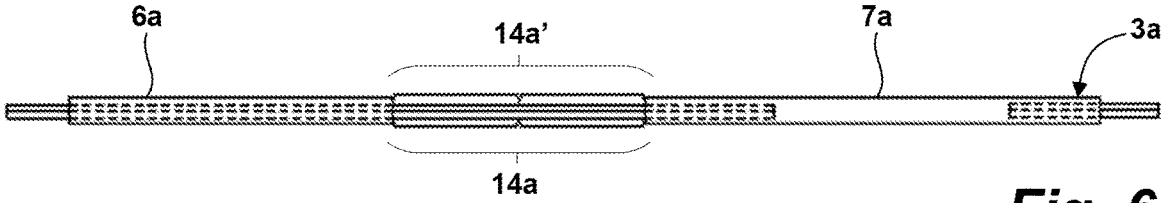
FIG. 6 is a top view of the locking assembly shown in FIG. 5.
Figure 7:
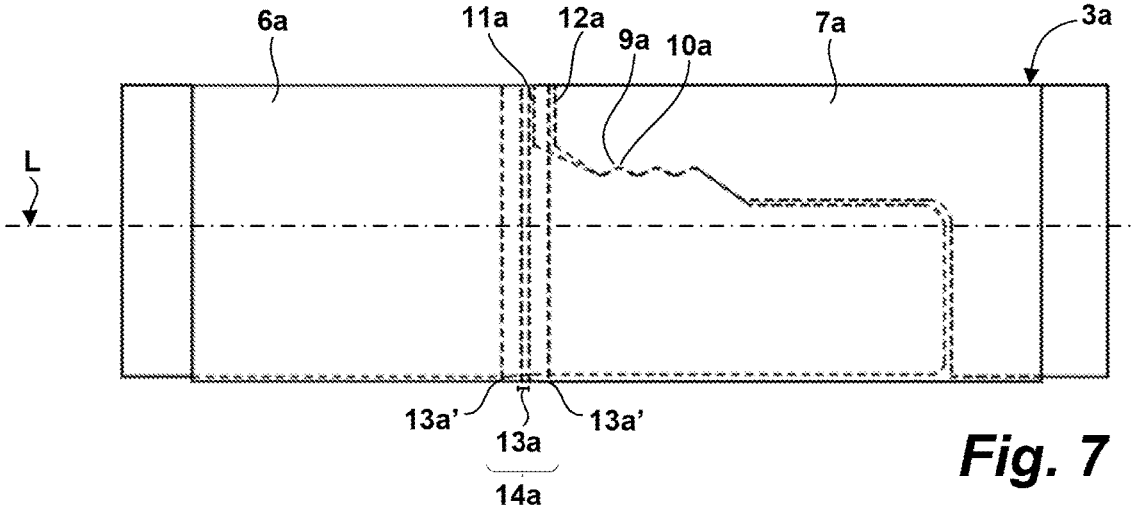
FIG. 7 shows the locking assembly of FIGS. 5-6 in its retracted, locking form.

The at least one protrusion 9*a* shown in FIG. 5 has the shape of a toothed edge portion of the tongue member 6*a* and the at least one recess 10*a* has a matching toothed edge portion of the receiving member 7*a*. The protrusion 9*a* may also have just one tooth (not shown), instead of the three teeth shown here. Alternatively, it may have two teeth or more than three teeth. In either case, the toothed edge portions of the tongue member 6*a* and the receiving member 7*a* provide a stepwise locking engagement between the tongue member 6*a* and the receiving member 7*a* when they are interacting. In other words, there is no interaction between the tongue member protrusion 9*a* and the receiving member recess 10*a* in the extended form of the locking assembly (FIGS. 5-6).

In a second version shown in FIGS. 9-12, the at least one protrusion 9*b* of the tongue member 6*b* is disposed on an outer side edge portion of the tongue member 7*b* and protrudes in a direction perpendicular to a longitudinal axis L of the locking assembly 3*b*. Accordingly, the matching recess 10*b* is provided on an outer side wall portion of the locking assembly 3*b*, i.e. protruding in a direction substantially parallel with the center axis C of the stand 1.

The engagement between the protrusion 9*a*, 9*b*, 9*c* and the recess 10*a*, 10*b*, 10*c* occurs when the two parts are brought into contact with each other by an applied outer force F, F', for example through a person's hand from the outside of the panels 2, 2' of the stand 1. Two opposite arrows F, F' are shown in FIG. 3 to illustrate the applied force on the edge portions 4, 4' of the panels 2, 2' leading to the second formation of the stand 1. The transition between the extended form and the locking form of the locking insert 3 leads to a change in the formation of the stand 1 due to the attachment between the ends of the locking assembly 3 and the edge portions 4, 4' of the panels 2, 2'. By applying the external force F, F' to the sides of the stand 1, i.e. the edge portions 4, 4' of the panels 2, 2', the stand 1 transitions from its idle position to its position of use. Conversely, by pulling the panel edges portions 4, 4' in an opposite direction the stand 1 transitions from its position of use to its idle position.

Figure 13:
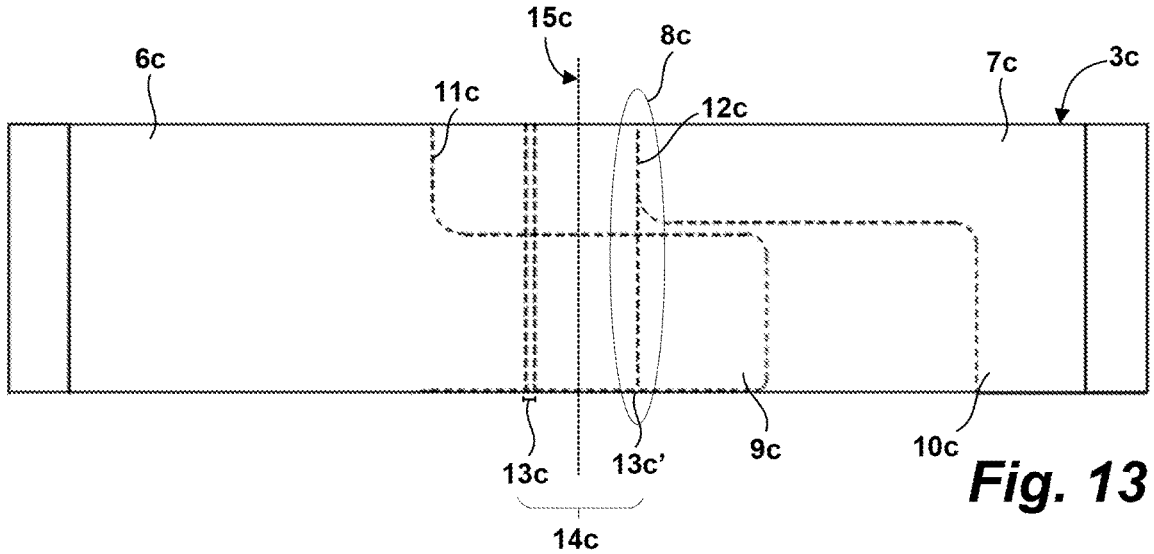
FIG. 13 shows a locking assembly of a third embodiment in its extended form.

In a third version of the locking assembly 3*c* shown in FIGS. 13-16, the at least one protrusion 9*c* of the tongue member 6*c* is provided at a free end portion of the tongue member 7*c* as shown in FIG. 13. In this case, the at least one recess 10*c* has the shape of a cut-out portion of the receiving member 7*c*, such that the protrusion 9*c*, here in the form of a narrowed extension of the tongue member 6*c*, is brought into contact with the matching recess 10*c* when the locking assembly 3*c* is in its retracted form.

When the tongue member 6*a*, 6*b*, 6*c* and the receiving member 7*a*, 7*b*, 7*c* in the three locking insert versions described above are brought together by for example an applied outer force, a stopping mechanism is established in the locking insert. This stopping mechanism occurs through engagement between the at least one protrusion 9*a*, 9*b*, 9*c* of the tongue member 6*a*, 6*b*, 6*c* and the corresponding at least one recess 10*a*, 10*b*, 10*c* of the receiving member 7*a*, 7*b*, 7*c*, thereby keeping the stand 1 in the second expanded formation. The stopping mechanism based on the engagement between matching engagement or abutment means of the kind described, can be of the snap or snap-in type.

Figure 9:
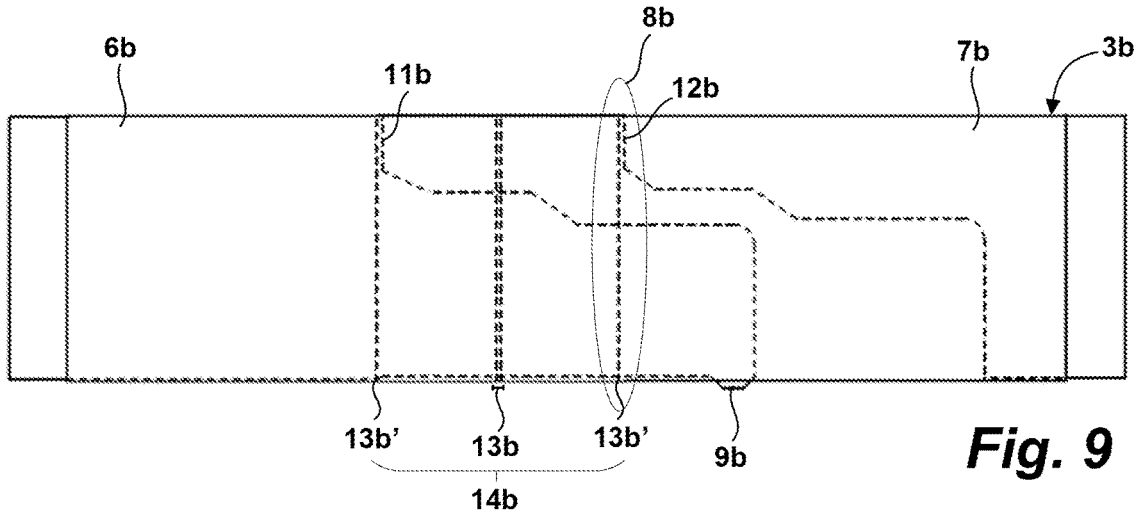
FIG. 9 shows a locking assembly of a second embodiment in its extended form.

The locking insert 3, 3' is shown in its extended position in FIGS. 5, 9, and 13. Here, the dashed lines indicate crease lines 13*a*, 13*a'*, 13*b*, 13*b'*, 13*c*, 13*c'*, where the material is folded due to an applied outer force F, F', such as through a user's hand from the outside of the panels of the information display stand. When in its retracted form, the locking assembly 3, 3' has two central wall portions 14*a*, 14*a'*, 14*b*, 14*b'*, 14*c*, 14*c'* protruding in opposite directions with respect to a central plane CP of the locking assembly 3, 3'. These two central wall portions 14*a*, 14*a'*, 14*b*, 14*b'*, 14*c*, 14*c'* are able to protrude in a direction away from the central plane CP as a result of the applied pressure leading to the folding of the locking insert material in the respective crease lines 13*a*, 13*a'*, 13*b*, 13*b'*, 13*c*, 13*c'*. Furthermore, the central wall portions 14*a*, 14*a'*, 14*b*, 14*b'*, 14*c*, 14*c'* of the locking inserts 3*a*, 3*b*, 3*c* are configured to engage with opposite inner surfaces of the panels 2, 2' during the transition between the first and second formation of the stand 1.

Figure 8:
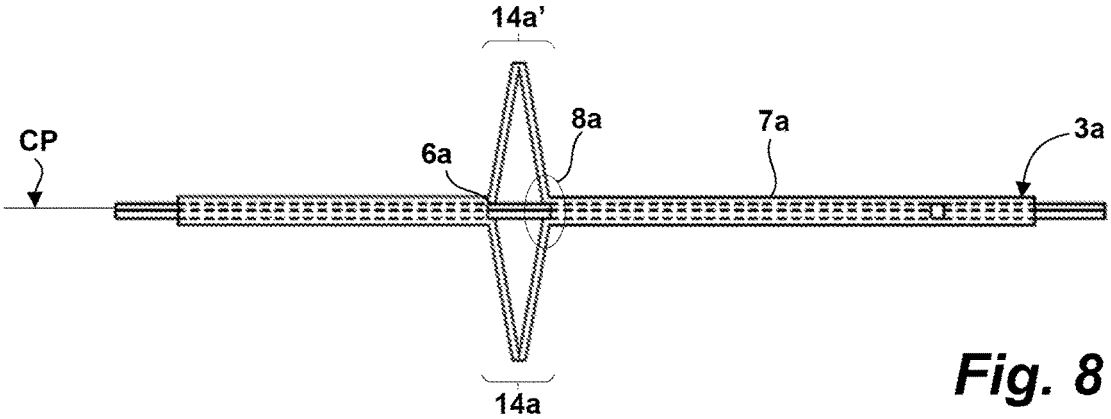
FIG. 8 is a top view of the locking assembly shown in FIG. 7.
Figure 12:
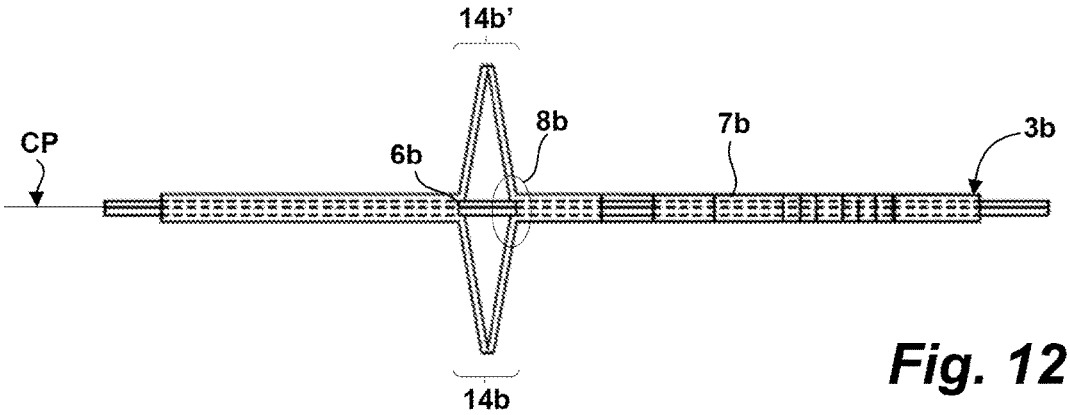
FIG. 12 is a top view of the locking assembly shown in FIG. 11.
Figure 16:
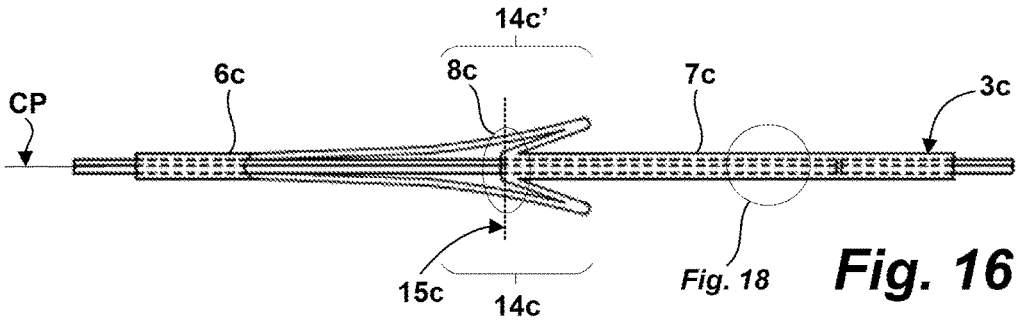
FIG. 16 is a top view of the locking assembly shown in FIG. 15.

When the locking assembly 3*a*, 3*b*, 3*c* is in its retracted form, at least one of the two central wall portions 14*a*, 14*a'*, 14*b*, 14*b'*, 14*c*, 14*c'* has a pointed shape with an outer tip which in the transition between the first and second formation of the stand 1 is in engagement with the inner surface of the adjacent panel 2, 2'. The tip is not necessarily pointing, as long as the central wall portions 14*a*, 14*a'*, 14*b*, 14*b'*, 14*c*,

14*c*' can develop a tip-like shape as shown in FIGS. 8, 12 and 16, due to the folding of the material in the crease lines 14*a*, 14*a*', 14*b*, 14*b*', 14*c*, 14*c*' on outer wall parts of the locking assembly as shown in FIGS. 5, 9, and 13.

As shown in FIG. 16, the central wall portions 14*c*, 14*c*' of the locking assembly 3*c* together include or form toggle joint means configured to shift the central wall portions 14*c*, 14*c*' of the locking assembly 3*c* between a first and a second wall portion position during transition between the extended and the retracted form of the locking assembly 3*c*, respectively. The toggle joint means functions in a way that if a small force is applied in a certain direction at a certain point, a larger force is created in the same direction. This way, in a situation where the outer tips of the two opposite central wall portions 14*c*, 14*c*' are furthest apart (i.e. the tips are as sharp as they can be), a tipping point 15*c* is reached, such that a small applied force on the tongue member side of this tipping point, leads to a transition of the locking assembly 3*c* from an extended form to a retracted form. Contrarily, a small applied force on the receiving member side of this tipping point 15*c*, will lead to a transition of the locking assembly 3*c* from a retracted form to an extended form. The extended and retracted forms of this type of locking insert 3*c* are illustrated in FIGS. 13-14 and FIGS. 15-16, respectively. The tipping point 15*c* may be further described as a position of the tongue member 6*c* in relation to the receiving member 7*c*, at which the indirect opposing forces acting on the central wall portions 14 are equal and dictated by the material features of the locking assembly 3*c*.

Figure 17:
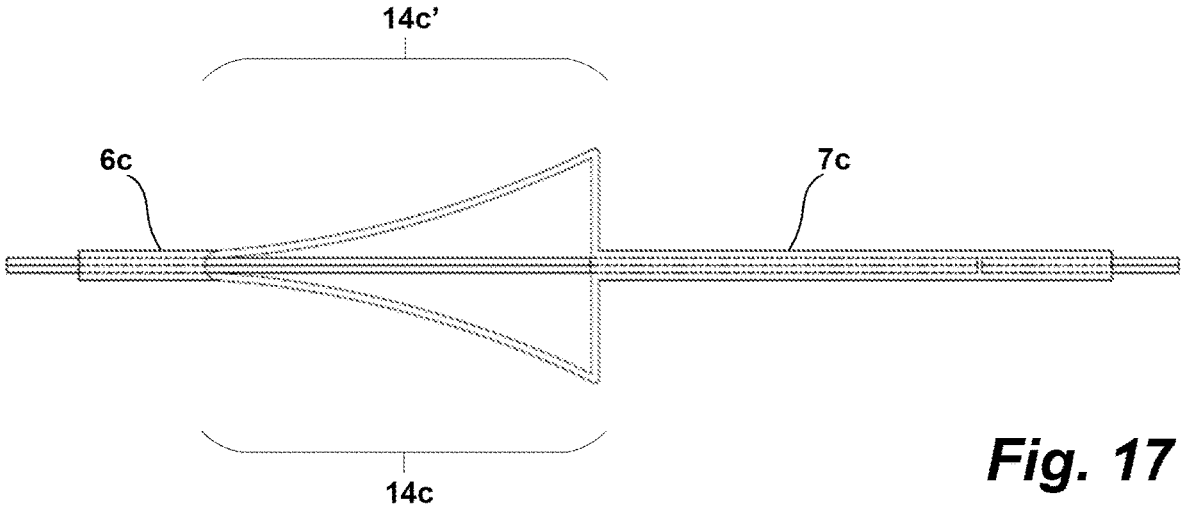
FIG. 17 shows an intermediate position of the locking assembly of FIGS. 13-16.

An intermediate position of the locking assembly 3*c*—between the extended and retracted forms—is shown in FIG. 17; illustrating the position of the toggle joint means just before the switch to either of the forms of the locking assembly. The small force required to "activate" the toggle joint means into switching between the first and second wall portion positions at the tipping point 15*c* can be understood in terms of a tipping point threshold, which in turn is determined by the material features of the locking assembly 3*c*.

Figure 10:
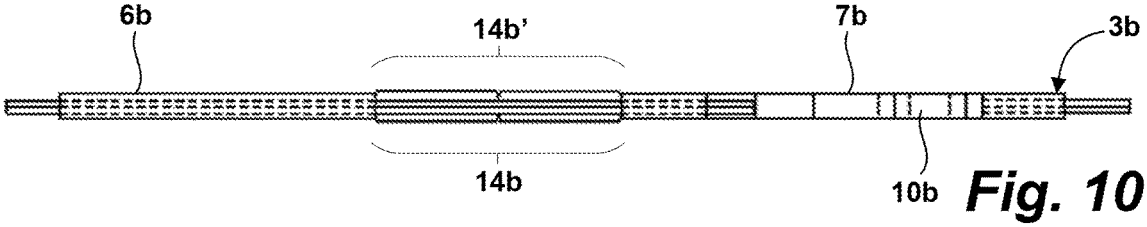
FIG. 10 is a top view of the locking assembly shown in FIG. 9.
Figure 11:
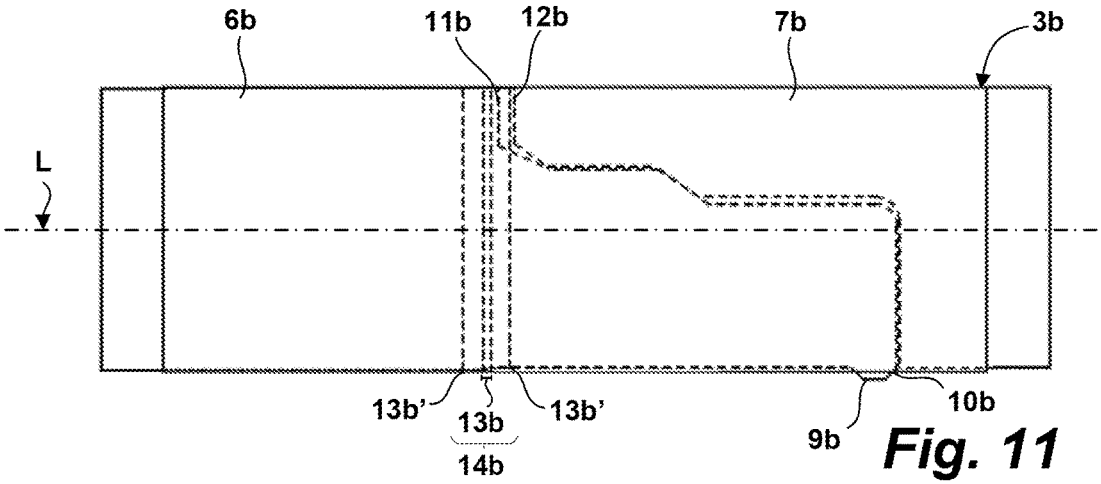
FIG. 11 shows the locking assembly of FIGS. 9-10 in its retracted, locking form.
Figure 14:
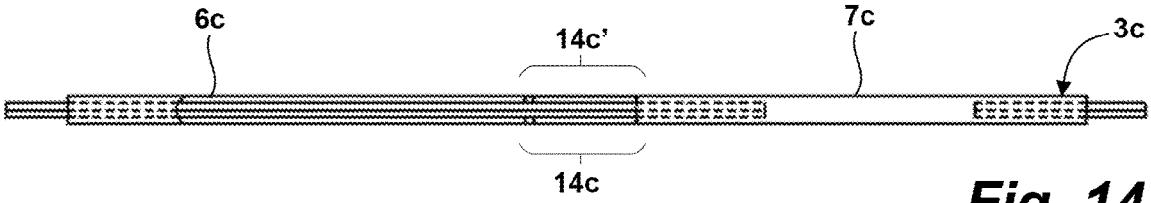
FIG. 14 is a top view of the locking assembly shown in FIG. 13.
Figure 15:
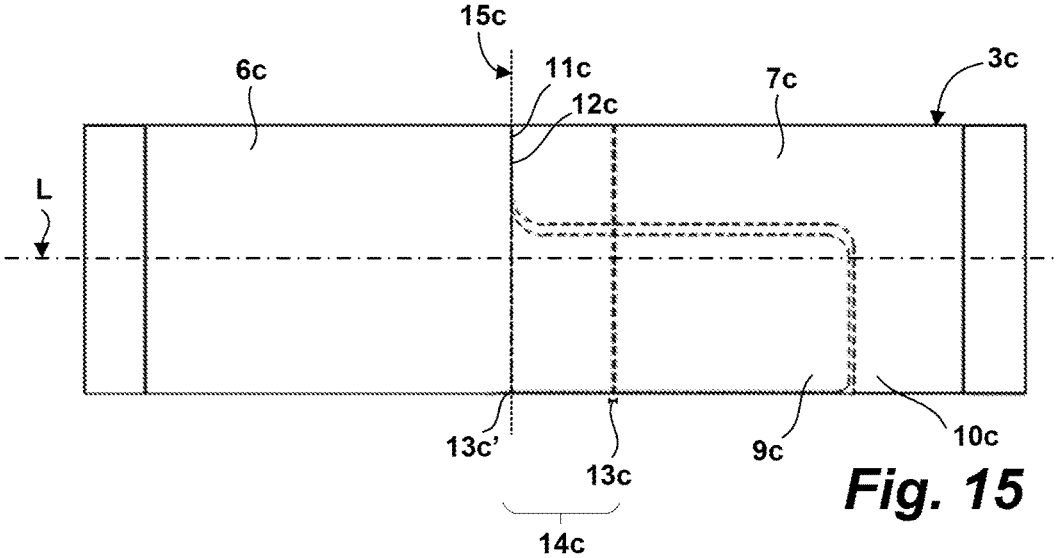
FIG. 15 shows the locking assembly of FIGS. 13-14 in its retracted, locking form.

In all versions of the locking assembly 3*a*, 3*b*, 3*c*, the sliding connection between the tongue member 6*a*, 6*b*, 6*c* and a tongue receiving area of the receiving member 7*a*, 7*b*, 7*c* is substantially frictionless. In other words, the locking assembly 3*a*, 3*b*, 3*c* is a mechanical locking means rather than a friction-based locking means. To fulfil this requirement, the material thickness T of the tongue member 6*a*, 6*b*, 6*c* which is to be received in the tongue receiving area is smaller than the distance D between the opposite sliding connection surfaces of the tongue receiving area of the receiving member 7*a*, 7*b*, 7*c*. Preferably, the thickness T of the tongue member 6*a*, 6*b*, 6*c* is in the range of 40-90% of the distance D between the opposite sliding connection surfaces of the tongue receiving area of the receiving member 7*a*, 7*b*, 7*c*. More preferably, the thickness proportion is in the range of 55-75%. This tongue receiving area is shown in FIGS. 6, 10 and 14 as a white void.

Figure 18:
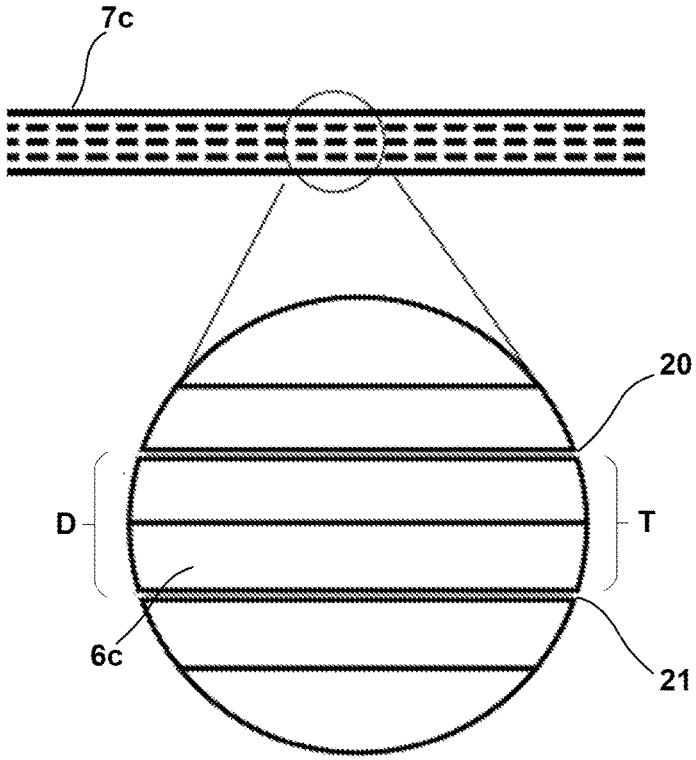
FIG. 18 is a blow-up taken from FIG. 16 showing material thicknesses.

The material thickness proportions of the locking insert 3*c* discussed above are illustrated in more detail in the blow-up of FIG. 18 taken from FIG. 16. The thickness proportions also apply for the locking inserts 3*a* and 3*b* shown in FIGS. 8 and 12, respectively. The thickness T of the tongue member 6*c* is smaller than the distance D between the spaced opposite surfaces in the tongue receiving area of the tongue receiving member 7*c*. The proportion T/D is in the range of 40-90%, preferably 55-75%. Hereby, an upper gap 20 and a lower gap 21 are formed between the tongue member 6*c* and opposite surfaces in the tongue receiving area of the receiving member 7*c*. In practice, these gaps 20, 21 can be a few millimetres wide. In a practical example, the tongue thickness T is about 8 mm and the distance D between opposite surface in the tongue receiving area is about 12 mm. Hence, gaps of about 2 mm are left on either side of the tongue.

Thanks to thickness proportions of this kind and the gaps 20, 21 left on either side of the tongue member 6*c*, a substantially frictionless connection between the tongue member 6*c* and the tongue receiving member is achieved. This promotes smooth telescopic mutual movements of the tongue member 6*c* and the tongue receiving member 7*c*, which is turn leads to a smooth switch between the idle position and the expanded formation of the stand 1.

Figure 19A:
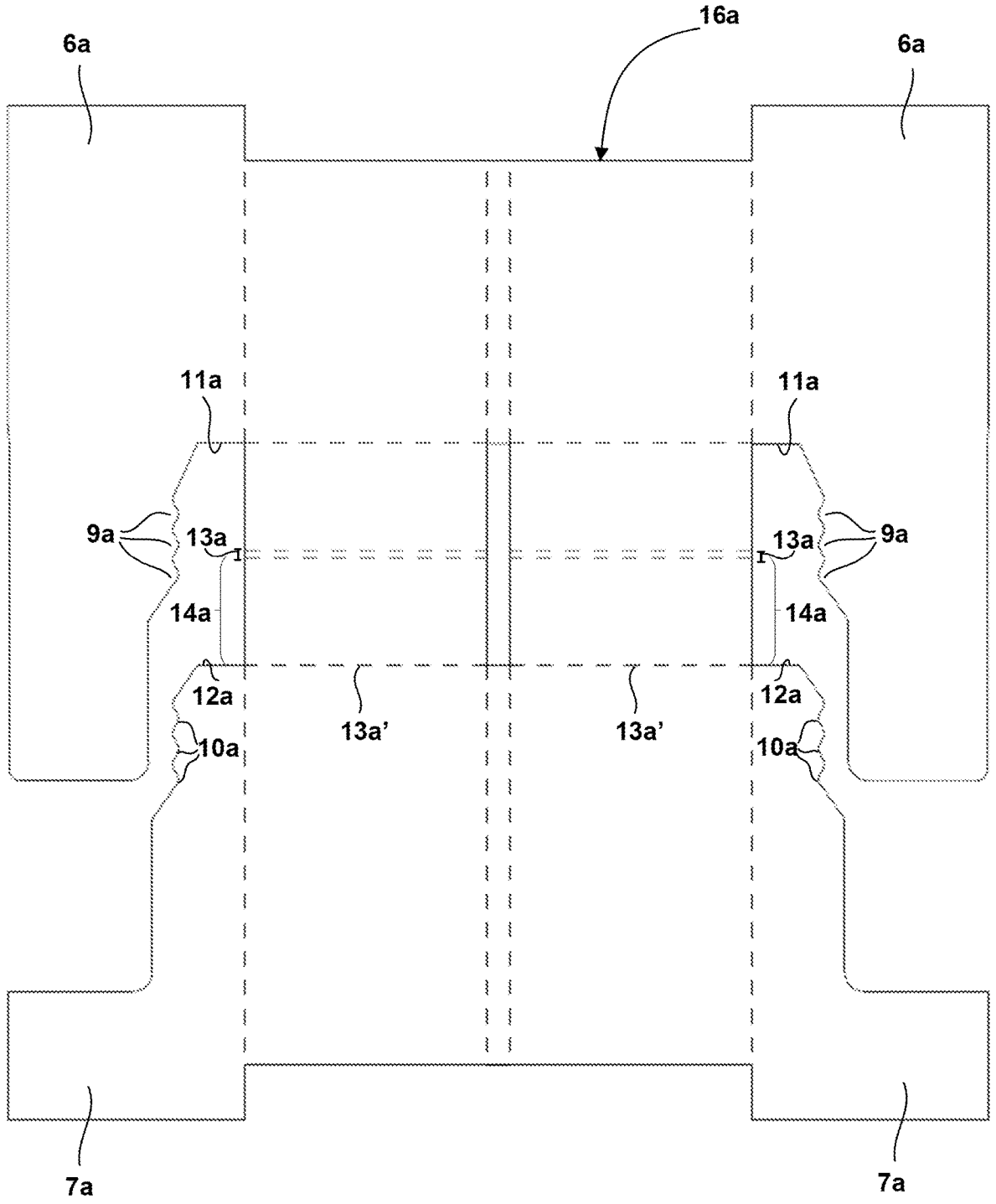
FIG. 19A shows a blank for forming the locking assembly of FIGS. 5-8.
Figure 19B:
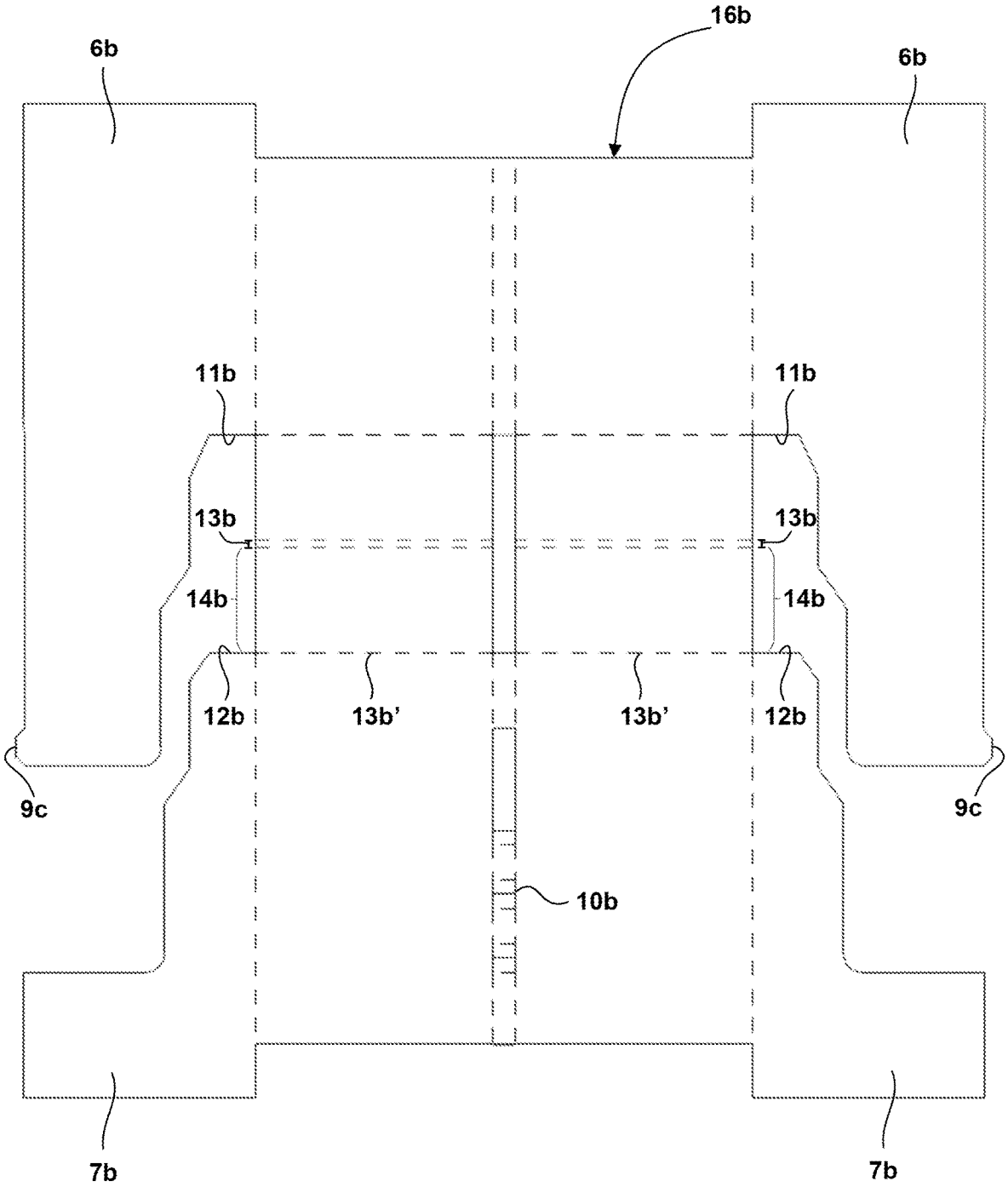
FIG. 19B shows a blank for forming the locking assembly of FIGS. 9-12.
Figure 19C:
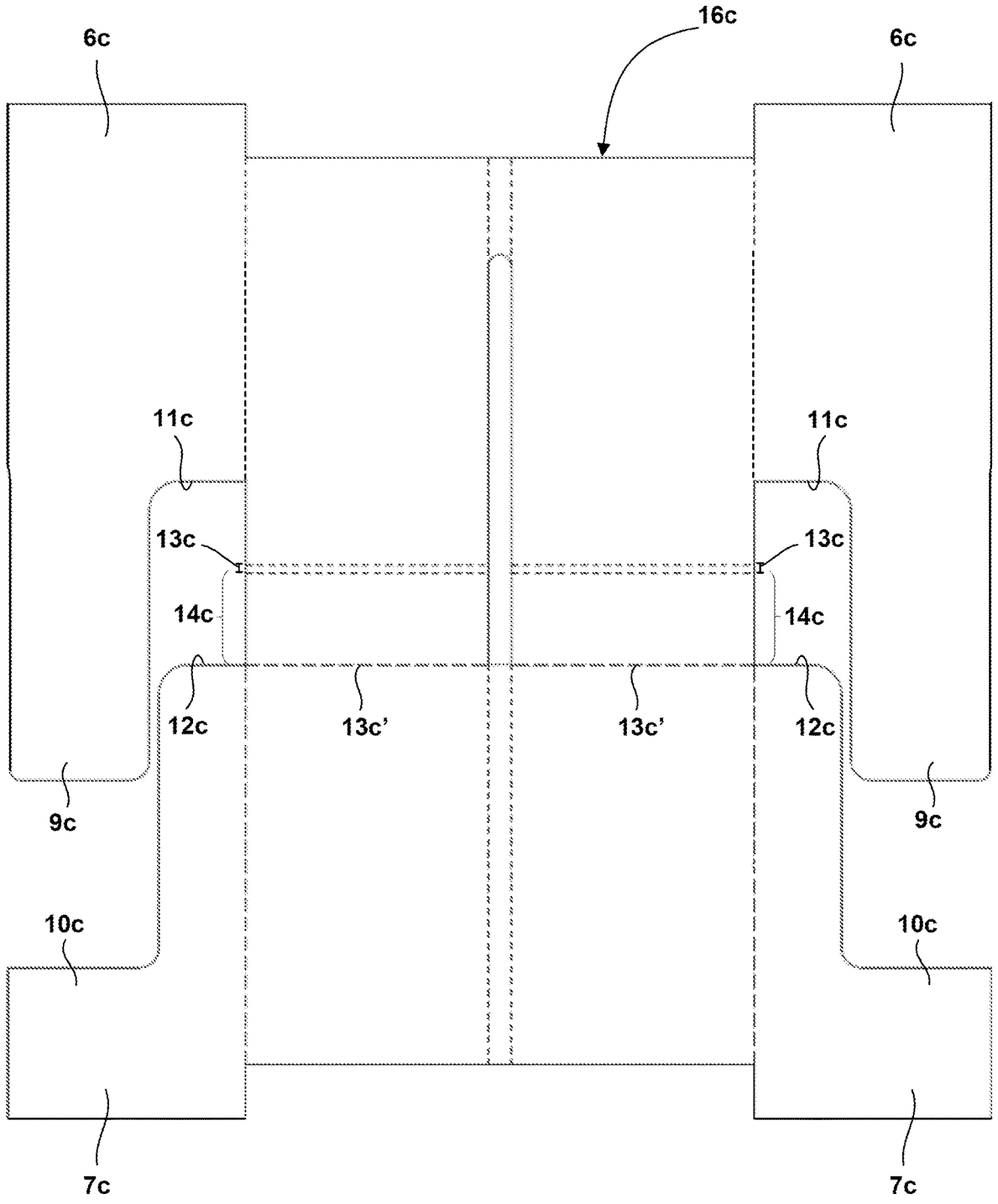
FIG. 19C shows a blank for forming the locking assembly of FIGS. 13-16.

In the following FIGS. 19A-C, the blanks forming the locking assemblies 3*a*, 3*b*, 3*c*, respectively, will be described. In each respective figure, there is shown a one-piece blank for forming the locking assembly 3*a*, 3*b* and 3*c* shown in FIGS. 5-8, 9-12 and 13-16, respectively. Each flat blank 16*a*, 16*b*, 16*c* has a number of flaps which are folded inwardly to form the locking insert 3*a*, 3*b*, 3*c* which is given a compact and stiff structure, which is favourable when fastened in the stand 1 between the panels 2, 2'. Fold lines and crease lines are shown in dashed lines. Preferably, the blank 16*a*, 16*b*, 16*c* is of corrugated board.

Figure 19D:
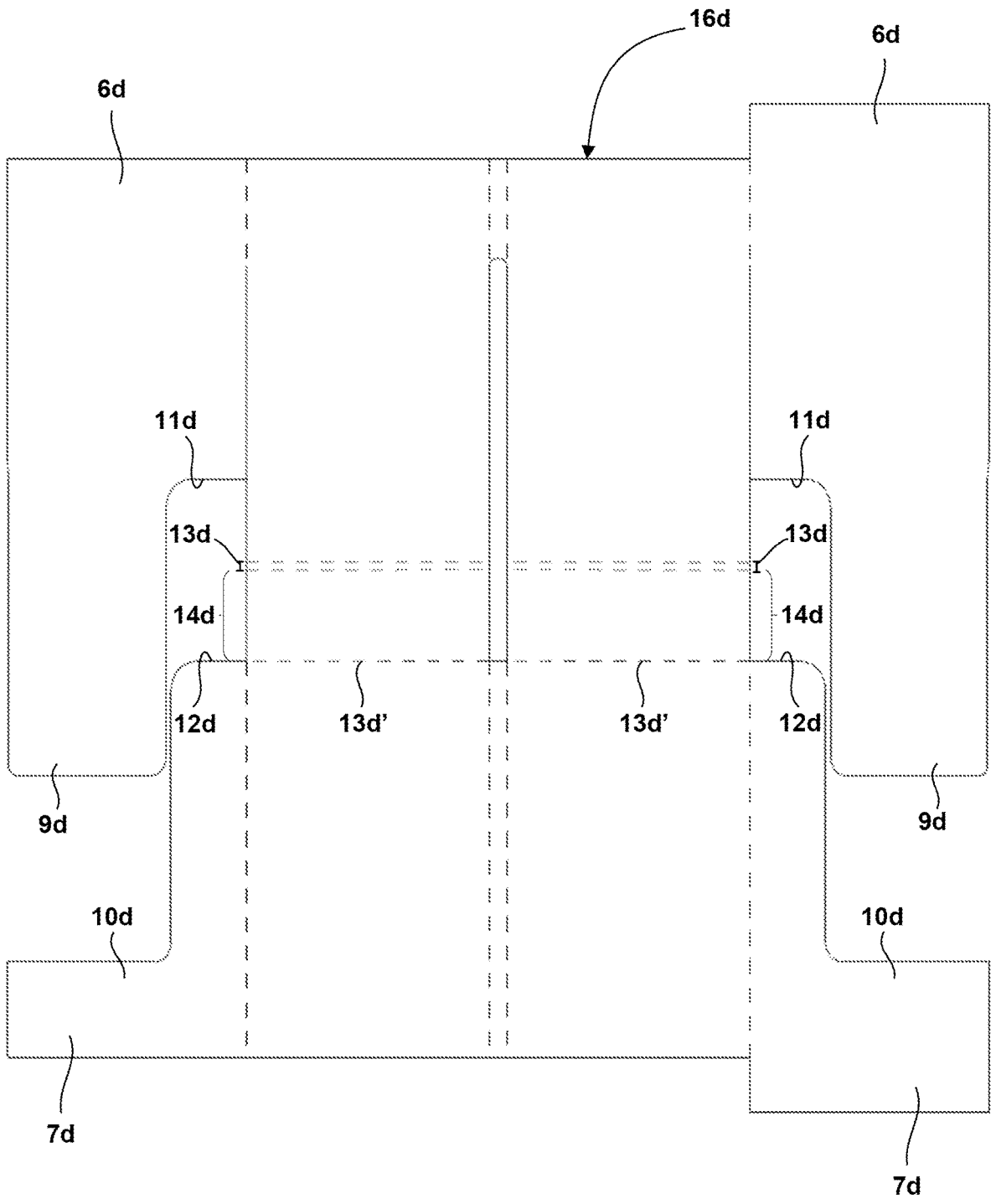
FIG. 19D shows another blank for forming a locking assembly of FIGS. 13-16, FIGS. 20A and 21A show how the blank of FIG. 19A is folded.

FIG. 19D shows a slightly modified, preferred version of the blank which corresponds to the third-version locking assembly 3*c* disclosed herein. When comparing the blanks 16*c* and 16*d* of FIGS. 19C and 19D it can be seen that there is only a slight difference in the shape of the tongue members 6*c*, 6*d* and the receiving members 7*c*, 7*d* on the left hand side of the respective blanks 16*c*, 16*d*. This is merely a structural difference which does not affect the mechanical properties of the locking assembly 3*c* other than requiring less material when producing the blank 16*d* shown in FIG. 19D. It is the locking assembly 3*d* which is currently used in practice.

Figure 21C:
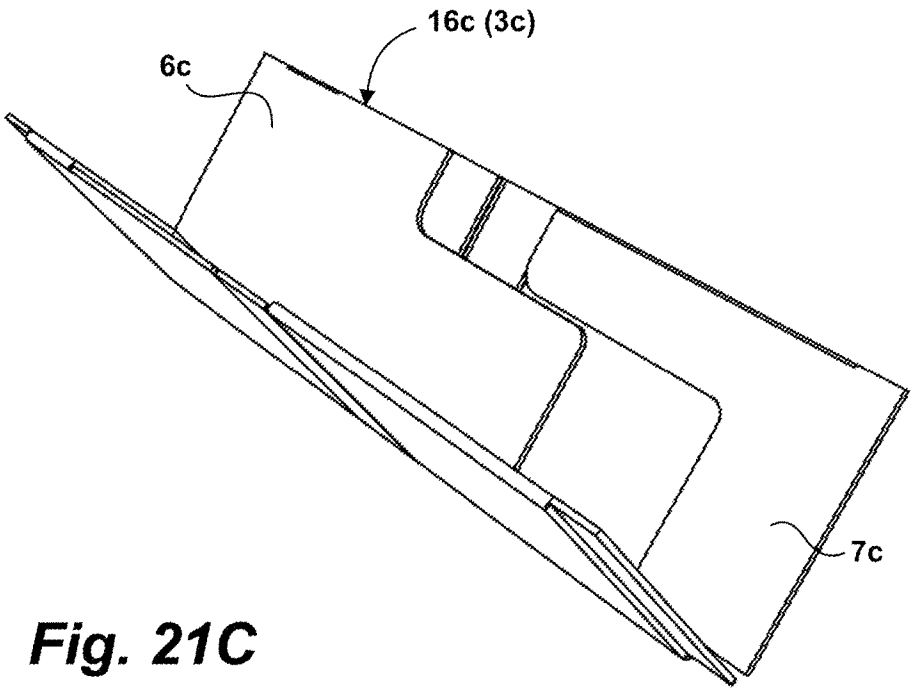
Figure 22A:
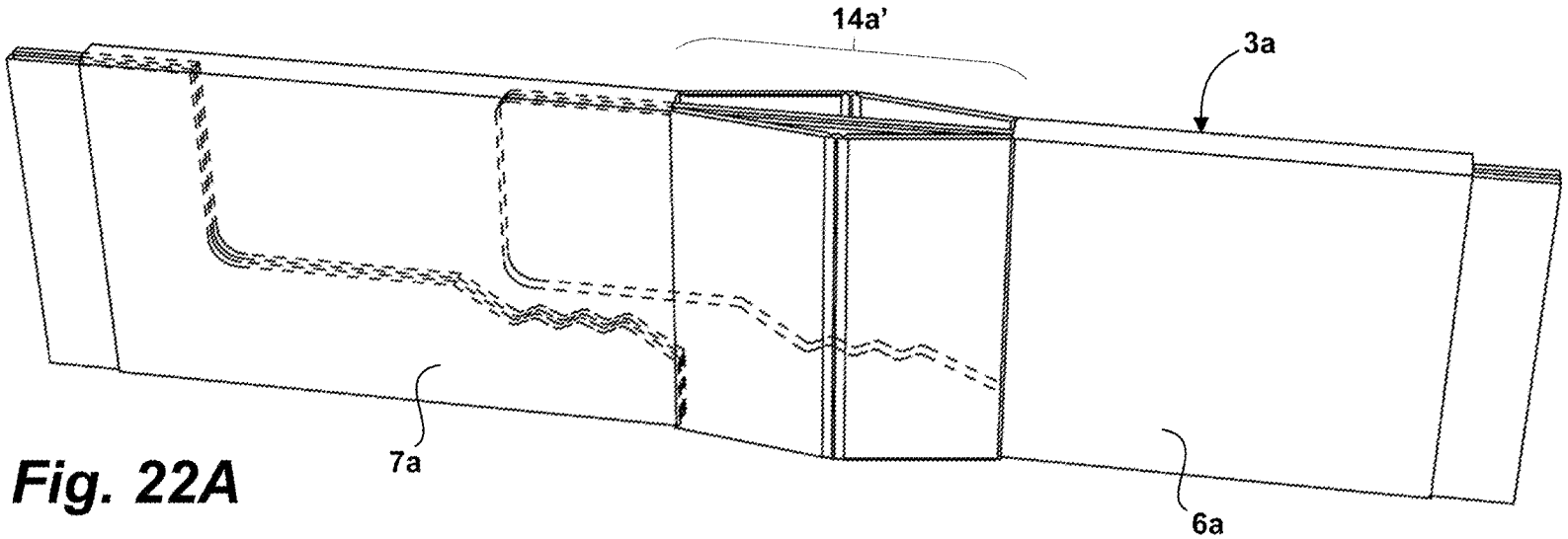
FIGS. 22A and 23A are perspective views of the assembly of FIGS. 5-8, FIGS. 22B and 23B are perspective views of the assembly of FIGS. 9-12, and FIGS. 22C and 23C are perspective views of the assembly of FIGS. 13-16.
Figure 23A:
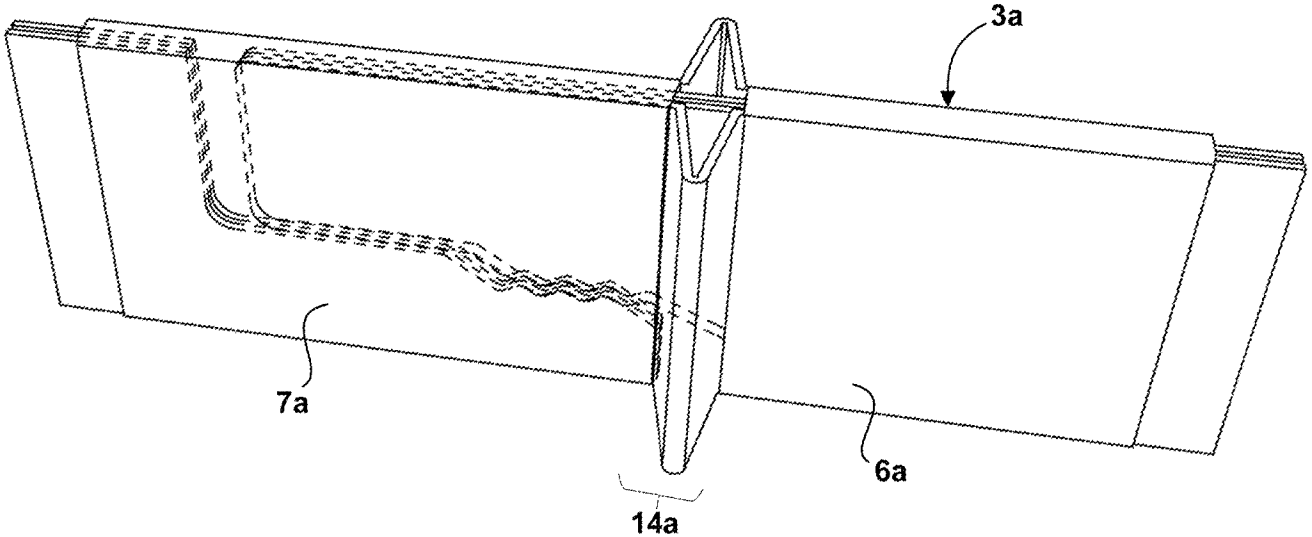
Figure 22B:
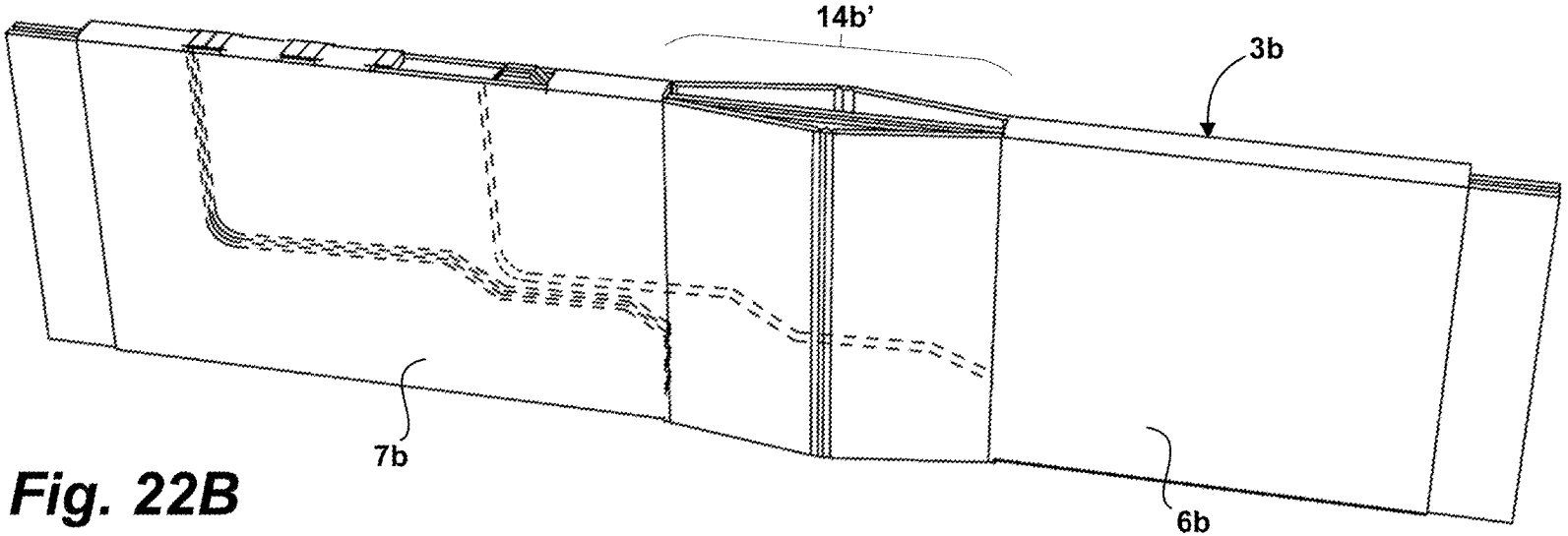
Figure 23B:
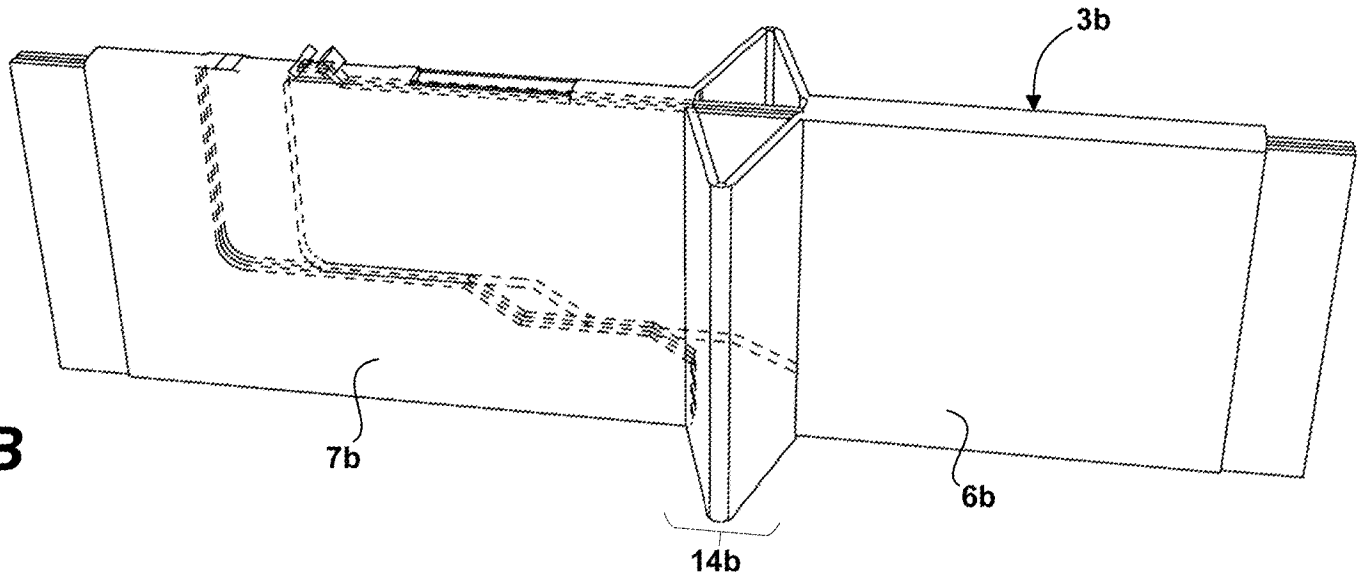
Figure 22C:
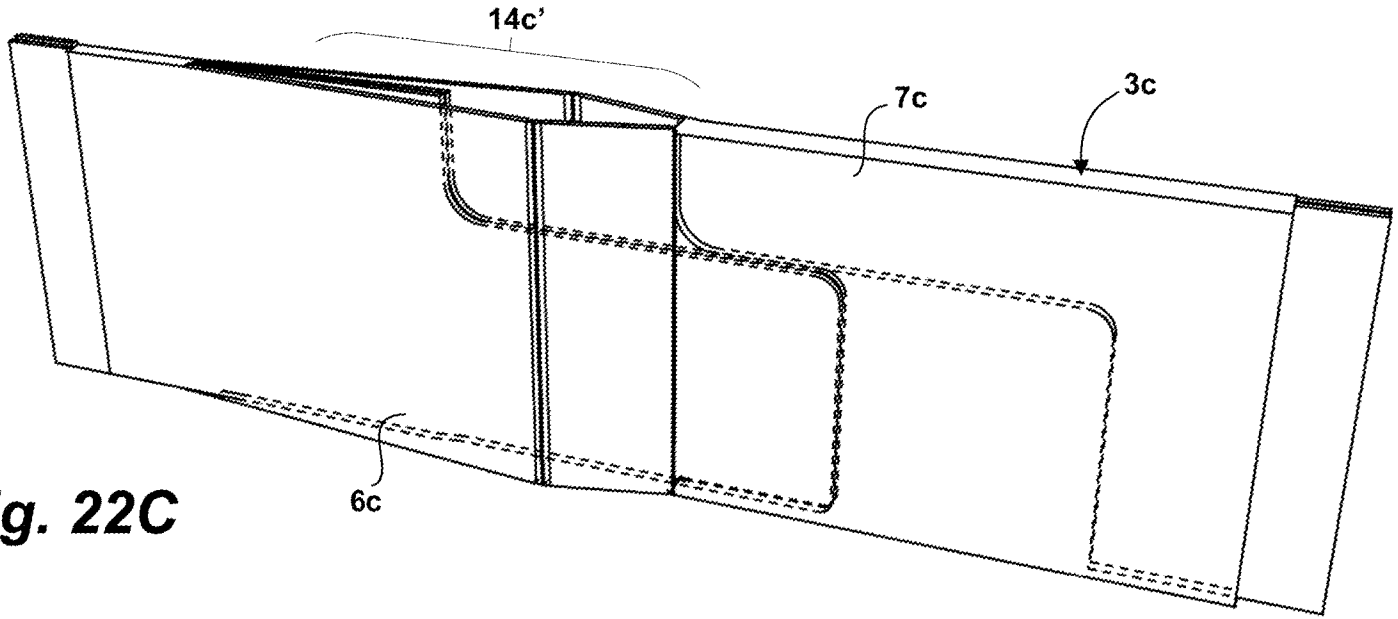
Figure 23C:
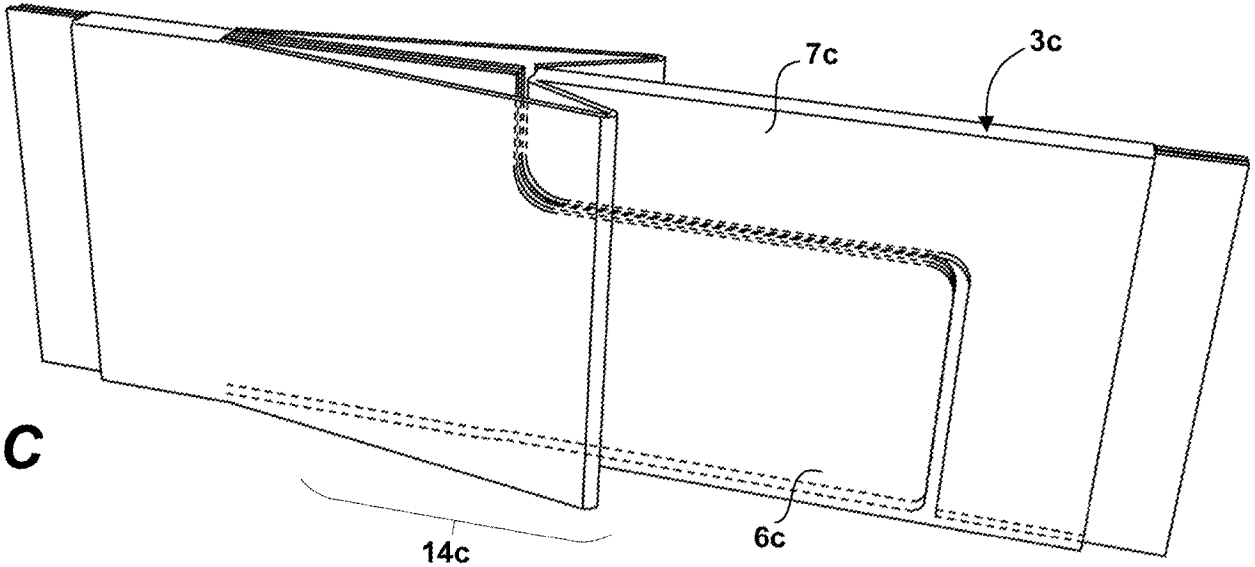

It should be noted that all references made to the locking assembly 3*c* in the description can equally be made to the locking assembly 3*d* of which its blank is illustrated in FIG. 19D, and the folded insert in FIGS. 22C and 23C. The blank 16*d* shown in FIG. 19D is thus folded the same way as the blank 16*c* shown in FIG. 19C. Reference is made to FIGS. 20C and 21C where the same folding procedure applies to both the blank 16*c* as well as the blank 16*d*. Furthermore, the locking assembly 3*c* shown in FIGS. 22C and 23C corresponds to the locking assembly shown in FIGS. 13-16 as well as FIG. 17. The locking assembly 3*d* is not shown in a folded version since it would be illustrated the same way as the folded version of the locking assembly 3*c* as shown, for instance, in FIGS. 22C and 23C. For simplicity, only the locking assembly 3*c* will be referred to below. Nevertheless, what applies to the locking assembly 3*c* also applies to the locking assembly 3*d*.

In the following, a method of forming the locking assemblies 3*a*, 3*b*, 3*c* (and 3*d*) starting from the blanks 16*a*, 16*b* and 16*c* will be illustrated schematically. For simplicity, the figures ending with capital letter "A" correspond to the embodiment of locking assembly 3*a*. Similarly, the figures ending with capital letter "B" correspond to the embodiment of locking assembly 3*b* and finally, the figures ending with capital letter "C" correspond equally to the embodiment of either one of locking assemblies 3*c* or 3*d* in terms of the shape of the folded locking assembly or insert.

Figure 20A:
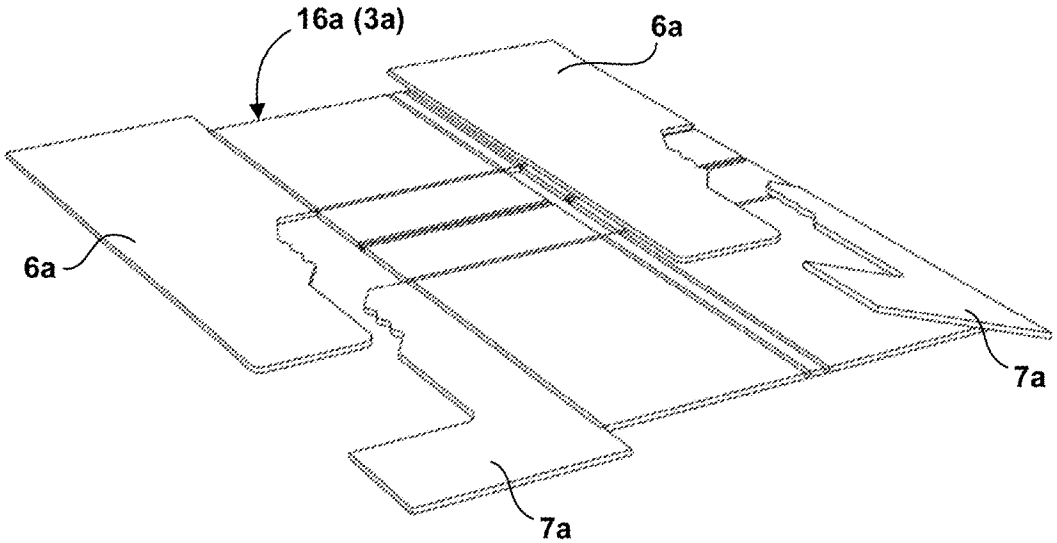
FIGS. 20B and 21B show how the blank of FIG. 19B is folded.
FIGS. 20C and 21C show how the blanks of FIG. 19C or 19D are folded.
Figure 21A:
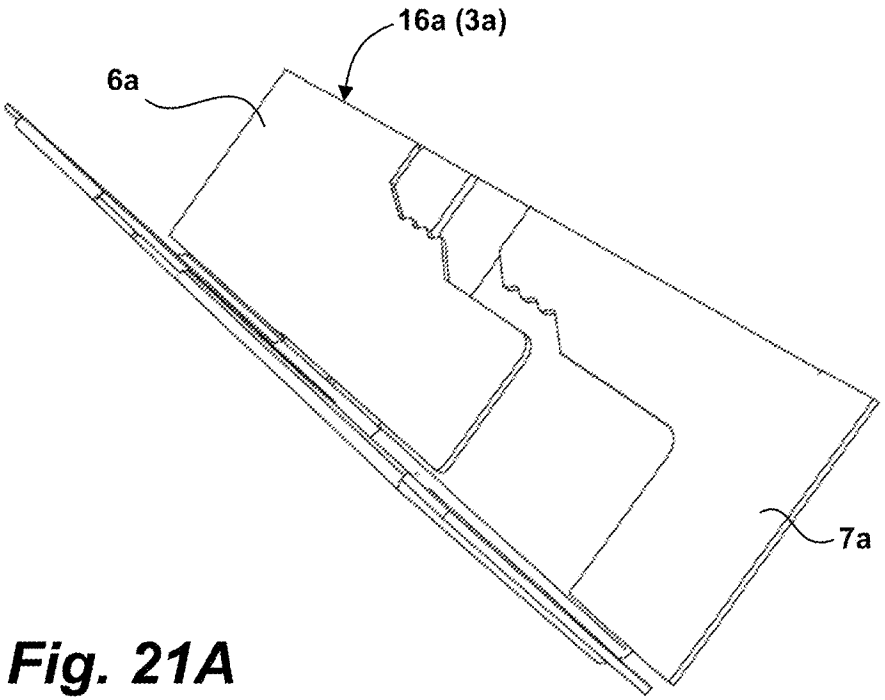

The locking assembly 3*a* of the first embodiment is formed from a one-piece blank 16*a* in the way shown in FIGS. 20A and 21A. Flaps are folded along folding lines, and the result is the locking assembly 3*a* shown in two perspective views in FIGS. 22A and 23A, respectively; first the extended form and second the retracted form. It should be noted, however, that the locking assembly 3*a* in FIG. 23A is not retracted to its full extent. If it were to be fully retracted, the toothed edge portions (dashed lines simulating the interior parts of the locking assembly 3*a*) would establish a form locking engagement and the central wall portions would be even more pointed in a transverse direction outwardly from the locking assembly 3*a*.

Figure 20B:
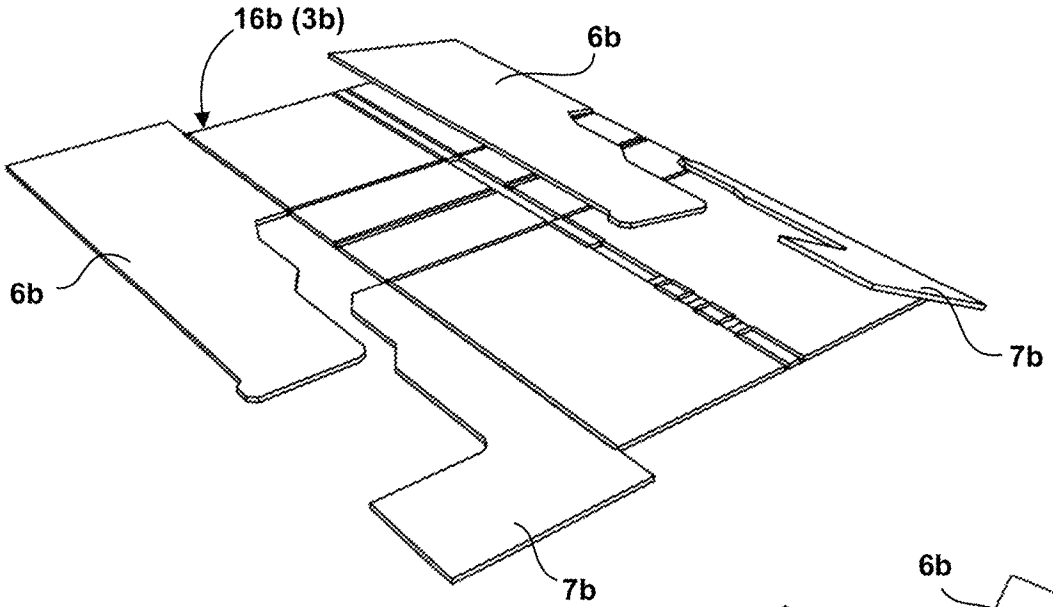
Figure 21B:
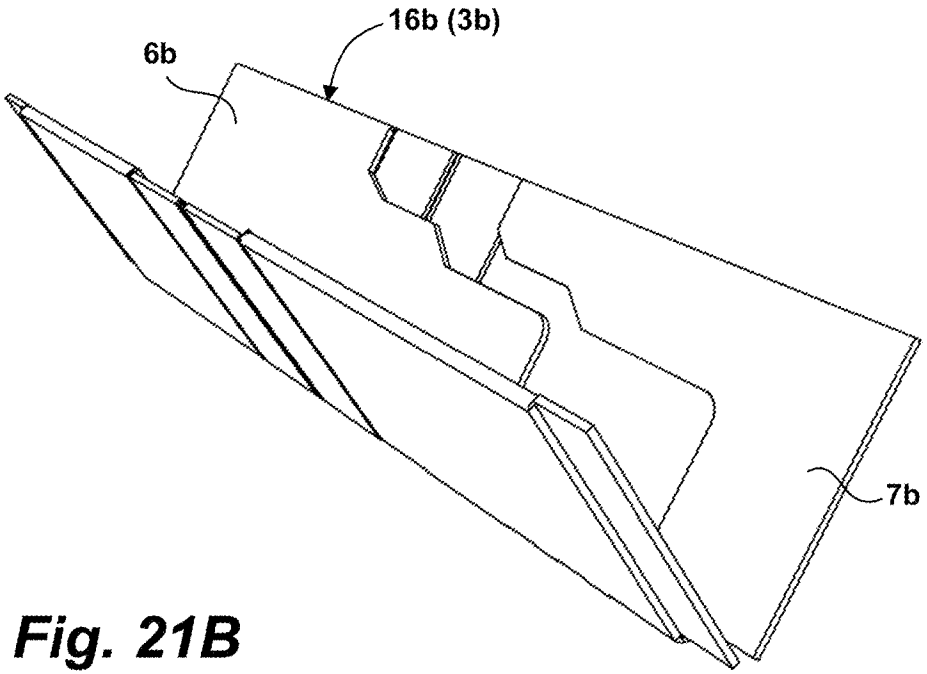
Figure 20C:
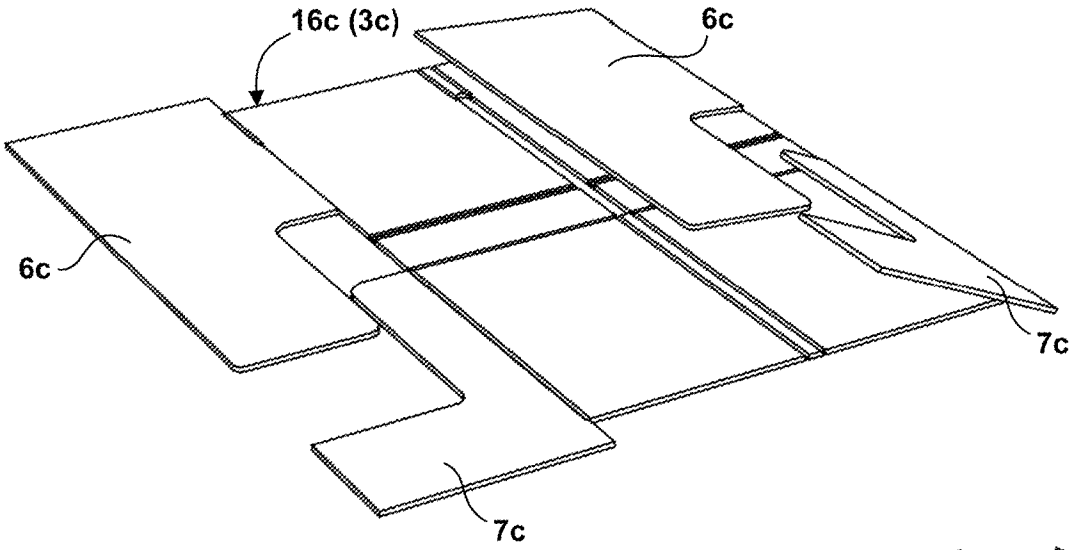

In a similar way, the locking assembly 3*b* of the second embodiment is formed from a one-piece blank 16*b* in the way shown in FIGS. 20B and 21B; resulting in the locking assembly 3*b* shown in the perspective views in FIGS. 22B and 23B. In FIG. 22B, the locking assembly 3*b* is in the extended form and, similarly to what has been previously described in relation to the first embodiment, the locking assembly 3*b* in FIG. 23B is not retracted to its full extent.

The locking assembly 3*c* is formed from a one-piece blank 16*c* in the way shown in FIGS. 20C and 21C. As mentioned above, a locking assembly 3*d* formed from the blank 16*d* shown in FIG. 19D would be folded the same way as in FIGS. 20C and 21C and have substantially the same final shape and qualities as the locking assembly or insert 3*c* shown in FIGS. 22C and 23C. The difference between the locking assemblies 3*c* and 3*d* is that less material is required to produce the latter. In FIG. 22C the locking assembly 3*c* is in its extended form and, contrarily to FIGS. 23A and 23B, the locking assembly 3*c* is shown in a completely retracted form in FIG. 23C. Here, the transition between the extended form and the retracted locking form has been established by overcoming the tipping point threshold, thus immediately bringing the two opposite central wall portions 14*c*, 14*c*' to a kind of resting position on the side of the tipping point 15*c* (not shown) facing the receiving member 7*c*. The transition is promoted by the toggle joint means associated with the locking inserts 3*c* and 3*d* shown for instance in FIGS. 22C and 23C, the toggle joint means having been described previously.

To better understand the tipping point mechanism of the locking assembly 3*c* of the third embodiment and to comply with FIGS. 13-17, the tongue member 6*c* is shown on the left side in FIGS. 22C and 23C. This is not the case for the locking assemblies 3*a* and 3*b* of the first and second embodiments, where the tongue member 6*a* and 6*b* is shown on the right side in FIGS. 22A, 23A, 22B and 23B.

The folding process described above is very efficient and can be performed at high speed in a folding machine. The locking inserts can be delivered separately to facilities where pop-up stands are manufactured, but it is also possible to produce complete pop-up stands more or less in-line. In this case, locking inserts are produced in a first station and fed to a second station where they are placed between panels and fastened by their ends to the inner edges of the opposite panels making up the stand. The folding machine used in the second station can for instance be of the type described in the patent SE-C-537,072 which is hereby incorporated by reference.

Standard lengths of locking inserts of the type described herein is about 500-550 mm, oftentimes about 535 mm, but the locking inserts according to the embodiments described herein are more flexible in terms of length. In particular, longer locking inserts are achievable by means of the improved locking inserts herein.

As mentioned above, the locking inserts are preferably formed from a one-piece blank which is folded in a number of folding steps. Preferably, the blank is made of some kind of paper-based material suitable for folding. A favourable material is corrugated board which can have some kind friction-impeding surface layer or coating.

In terms of dimensions, the width of the stand 1 is in the range of 25-35% of its height. Depending on which formation the stand 1 has, its cross-dimension will vary.

For example, the stand 1 may have an edge-to-edge dimension between the panel edges 4, 4' of about 525 mm, whereas in its position of use, this transverse dimension can be about 420 mm.

Typically, the height of the locking assembly is in the range of 15-30% of its length, where the height is determined in relation to the center axis C of the stand 1. Preferably, the height is about 20-25% of its length.

Finally, it should be mentioned that the invention is by no means limited to the embodiments described herein and many modifications are feasible without departing from the spirit of the invention. For instance, the locking assemblies may be arranged on either side of the fold lines of the stand. In general, at least one locking insert is arranged between the panels and a dual-locking-insert-stand is described herein. For tall information display stands, more than two locking inserts can be used. There may be additional fold lines on the panels, and the number of fold lines may be determined by the number of locking inserts.

The invention claimed is:

1. An information display stand configured to assume a first formation in which the stand is planar for storage or transportation, and a second formation in which the stand is expanded and capable of assuming an upright displaying position, the stand having a center axis and comprising:

at least two panels that are joined together along respective edge portions, such that the stand in the second formation forms a tubular shape; and at least one elongated locking assembly arranged between the two panels, the locking assembly extending transversely with respect to the center axis, the locking assembly having respective ends attached to the panels at the respective edge portions, and the locking assembly being configured to assume an extended form corresponding to the first formation of the stand, and a retracted locking form corresponding to the second formation of the stand;

wherein the locking assembly includes a tongue member and a receiving member, the tongue member being in sliding connection within an opening of the receiving member;

wherein the tongue member includes at least one protrusion configured to engage with at least one matching recess in the receiving member, such that when the tongue member and the receiving member are brought together a stopping mechanism is established by engagement between the protrusion and the recess, thereby keeping the stand in the second formation; and wherein the at least one protrusion is provided on a tongue member edge portion and the matching recess is provided on an opposite receiving member edge portion of the receiving member, the tongue member edge portion and the receiving member edge portion being disposed within the locking assembly.

2. The information display stand according to claim 1, wherein the at least one protrusion is provided on an edge portion of the tongue member which is directed outwards from a longitudinal axis of the locking assembly and wherein the matching recess is provided in an outer side wall portion of the locking assembly.

3. The information display stand according to claim 1, wherein the at least one protrusion is provided at a free end portion of the tongue member.

4. The information display stand according to claim 1, wherein the locking assembly in its retracted locking form has two central wall portions protruding in opposite directions with respect to a central plane of the locking assembly.

5. The information display stand according to claim 4, wherein, when the locking assembly is in its retracted locking form, each of the two central wall portions has a tip-like shape.

6. The information display stand according to claim 5, wherein, when the information display stand transitions between the first and the second formations, each tip-like shape is in engagement with an inner surface of an adjacent panel.

7. The information display stand according to claim 4, wherein the two central wall portions together form toggle joint means for shifting between a first wall portion position and a second wall portion position during transition between the extended form and the retracted locking form of the locking assembly, respectively.

8. The information display stand according to claim 7, wherein the first and the second wall portion positions determined by the toggle joint means are induced by a tipping point determined by applied outer forces acting on the locking assembly, wherein a tipping point threshold is determined by the material features of the locking assembly.

9. The information display stand according to claim 4, wherein the central wall portions are configured to engage with opposite inner surfaces of the panels in the transition between the first and the second formations.

10. The information display stand according to claim 1, wherein the sliding connection between the tongue member and a tongue receiving area of the receiving member is substantially frictionless in that the distance between opposite sliding connection surfaces of the tongue receiving area of the receiving member is larger than the material thickness of the tongue member to be received in the tongue receiving area.

11. The information display stand according to claim 10, wherein the thickness of the tongue member is between 40-90% of the distance between the opposite sliding connection surfaces of the tongue receiving area of the receiving member.

12. The information display stand according to claim 11, wherein the thickness of the tongue member is 55-75% of the distance between the opposite sliding connection surfaces.

13. An information display stand configured to assume a first formation in which the stand is planar for storage or transportation, and a second formation in which the stand is expanded and capable of assuming an upright displaying position, the stand having a center axis and comprising:

at least two panels that are joined together along respective edge portions, such that the stand in the second formation forms a tubular shape; and at least one elongated locking assembly arranged between the two panels, the locking assembly extending transversely with respect to the center axis, the locking assembly having respective ends attached to the panels at the respective edge portions, and the locking assembly being configured to assume an extended form corresponding to the first formation of the stand, and a retracted locking form corresponding to the second formation of the stand;

wherein the locking assembly includes a tongue member and a receiving member, the tongue member being in sliding connected within an opening of the receiving member;

wherein the tongue member includes at least one protrusion configured to engage with at least one matching recess in the receiving member, such that when the tongue member and the receiving member are brought together a stopping mechanism is established by engagement between the protrusion and the recess, thereby keeping the stand in the second formation; and wherein the at least one protrusion comprises a toothed edge portion of the tongue member and wherein the at least one recess comprises a matching toothed edge portion of the receiving member, such that the toothed edge portions provide a stepwise locking engagement between the tongue member and the receiving member.

14. The information display stand according to claim 13, wherein the locking assembly in its retracted locking form has two central wall portions protruding in opposite directions with respect to a central plane of the locking assembly.

15. The information display stand according to claim 14, wherein, when the locking assembly is in its retracted locking form, each of the two central wall portions has a tip-like shape.

16. The information display stand according to claim 15, wherein, when the information display stand transitions between the first and the second formations, each tip-like shape is in engagement with an inner surface of an adjacent panel.

17. The information display stand according to claim 14 wherein the central wall portions are configured to engage with opposite inner surfaces of the panels in the transition between the first and the second formations.

18. The information display stand according to claim 13, wherein the sliding connection between the tongue member and a tongue receiving area of the receiving member is substantially frictionless in that the distance between opposite sliding connection surfaces of the tongue receiving area of the receiving member is larger than the material thickness of the tongue member to be received in the tongue receiving area.

19. The information display stand according to claim 18, wherein the thickness of the tongue member is between 40-90% of the distance between the opposite sliding connection surfaces of the tongue receiving area of the receiving member.

20. The information display stand according to claim 19, wherein the thickness of the tongue member is 55-75% of the distance between the opposite sliding connection surfaces.

* * * * *